US008099030B2

(12) United States Patent
Berg et al.

(10) Patent No.: US 8,099,030 B2
(45) Date of Patent: Jan. 17, 2012

(54) APPARATUS AND METHOD FOR DEVELOPMENT OF POTENTIAL IMAGES, PRODUCED ON AN INTERMEDIATE IMAGE CARRIER, FOR AN ELECTROGRAPHIC PRINTING OR COPYING DEVICE

(75) Inventors: Martin Berg, Poing (DE); Volkhard Maess, Pliening (DE); Andreas Wirtz, München (DE)

(73) Assignee: Oce Printing Systems GmbH, Poing (DE)

( * ) Notice: Subject to any disclaimer, the term of this patent is extended or adjusted under 35 U.S.C. 154(b) by 925 days.

(21) Appl. No.: 12/092,746

(22) PCT Filed: Nov. 14, 2006

(86) PCT No.: PCT/EP2006/068432

§ 371 (c)(1),
(2), (4) Date: May 6, 2008

(87) PCT Pub. No.: WO2007/057387

PCT Pub. Date: May 24, 2007

(65) Prior Publication Data

US 2008/0279597 A1 Nov. 13, 2008

(30) Foreign Application Priority Data

Nov. 18, 2005 (DE) ..... 10 2005 055 156

(51) Int. Cl.
*G03G 15/08* (2006.01)

(52) U.S. Cl. ..... 399/265; 399/279

(58) Field of Classification Search ..... 399/265, 399/279

See application file for complete search history.

(56) References Cited

U.S. PATENT DOCUMENTS

| | | | |
|---|---|---|---|
| 5,666,615 | A | 9/1997 | Nguyen |
| 6,371,024 | B1 | 4/2002 | Scholzig et al. |

FOREIGN PATENT DOCUMENTS

| | | | |
|---|---|---|---|
| DE | 44 01 299 | A1 | 7/1995 |
| DE | 44 08 615 | A1 | 9/1995 |
| DE | 696 13 869 | T2 | 8/1996 |
| EP | 0 146 088 | A1 | 6/1985 |
| EP | 0 727 720 | B1 | 8/1996 |
| EP | 1 097 813 | A2 | 5/2001 |

OTHER PUBLICATIONS

Mathes, H.: Gibt es optimale Kammerrakel? Teil 1 in Flexo+Tief-Druck Jan. 2003, pp. 54-58, Jan. 2003, Teil 3 in Flexo+Tief-Druck Jun. 2003, pp. 68-71.

*Primary Examiner* — David Gray
*Assistant Examiner* — Erika J Villaluna
(74) *Attorney, Agent, or Firm* — Schiff Hardin LLP

(57) ABSTRACT

In a system or method for development of potential images of images to be printed and generated on an intermediate image carrier using a developer fluid comprising charged toner particles and developer fluid in an electrographic printing or copying device, a feed device is provided comprising as function elements at least one chamber scraper, a raster element comprising cups to receiver the developer fluid, and at least one first flow element arranged in the chamber scraper. Between the at least one flow element and the raster element an electrical voltage is supplied such that a toner particle concentration in the cups of the raster element is increased. An application device accepts the developer fluid from the feed device and supplies it to the intermediate image carrier.

38 Claims, 5 Drawing Sheets

APPARATUS AND METHOD FOR DEVELOPMENT OF POTENTIAL IMAGES, PRODUCED ON AN INTERMEDIATE IMAGE CARRIER, FOR AN ELECTROGRAPHIC PRINTING OR COPYING DEVICE

RELATED APPLICATION

The present application is related to pending U.S. patent application Ser. No. 10/565,250 titled "Device And Method For Electrophoretic Liquid Development", Martin Berg, et al, filed Jan. 19, 2006.

BACKGROUND

For single-color or multicolored printing of a recording medium (for example of a single sheet or a band-shaped recording medium) made of the most varied materials (for example paper or thin plastic or metal films) it is known to generate image-dependent potential images (charge images) on an intermediate image carrier (for example a photoconductor) that correspond to the images to be printed, made up of regions that are to be inked and regions that are not to be inked. The regions of the potential images that are to be inked are made visible with a developer station (inking station) via toner. The toner image is subsequently transfer-printed onto the recording medium.

Toner particles and developer fluid containing carrier fluid can thereby be used for inking of the potential images. The carrier fluid thereby exhibits a resistance of greater than $10^8$ Ohm*cm. Possible carrier fluids are, among other things, silicon oil and hydrocarbons.

A method for electrophoretic fluid development (electrographic development) in digital printing systems is known from WO 2005/013013 A2, for example. A carrier fluid containing silicon oil, with ink particles (toner particles) dispersed therein, is thereby used as a developer fluid. More detail in this regard can be learned from WO 2005/013013 A2 corresponding to U.S. Ser. No. 10/565,250, which is a component of the disclosure of the present application.

The feed of the developer fluid to the intermediate image carrier can occur via an applicator roller to which the developer fluid is supplied by a raster roller at which a chamber scraper is arranged. The use of chamber scrapers for supplying ink is known from offset printing (EP 1 097 813 A2 corresponding to U.S. Pat. No. 6,371,024). The use of a chamber scraper in electrophoretic printing can be learned from WO 2005/013013 A2. A disadvantage of the known chamber scrapers is that the flow of the developer fluid is not directed in a targeted manner. Eddies can therefore occur and air bubbles can be introduced. The filling of the cups of the raster roller additionally occurs without potential assistance, such that the transition of the toner particles to the raster roller is limited. The achievable toner application per surface element is thereby limited, and with this the inking region or the speed of the transition of the developer fluid onto the raster roller, and with this the achievable process speed given constant inking.

The design of a raster roller that works together with a chamber scraper is known from DE 44 08 615 A1. In order to enlarge the shape of the cups of the raster roller, a voltage is applied to the chamber scraper and the raster roller. The raster roller is designed such that the shape of the cups can be altered via an electrical voltage.

Mathes, H. ("Gibt es die optimale Kammerrakel?" part 1 in Flexo+Tief-Druck 1-2003, p. 54-58, January 2003, part 3 in Flexo+Tief-Druck 6-2003, p. 68-71, November 2003) describes the realization of an arrangement made up of raster roller and chamber scraper. In order to press the air out from the cups of the raster roller upon filling with ink, it is proposed to direct the ink over the raster roller under pressure. For this a profile body in the chamber scraper can be arranged adjacent to the raster roller, via which profile body the transport channel for the ink is constricted adjacent to the raster roller.

According to EP 0 727 720 B1, the cleaning of the residual image (that remains after the development of the potential images on the applicator roller) from the applicator roller occurs via a scraper adjoining the applicator roller. However, an elastic coating of the applicator roller that is required for the neighboring image point formation at the intermediate image carrier is quickly abraded with this. To the contrary, if the contact pressure of the scraper is too weak, a low cleaning efficiency is accepted, which leads to memory effects given high print utilization (areal degree of coverage of the print image) since not every point of the applicator roller exhibits the same toner quantity/area after a cycle. The cleaning of the applicator roller can also occur via a cleaning roller with scrapers. Since the toner particles are then drawn towards the surface of the cleaning roller, this leads to high stress on the toner particles at the point of action of the scraper on the cleaning roller. This leads to the agglomeration of toner particles and macroscopic thickenings. If the efficiency of the scraper is insufficient, this leads to film formation on the cleaning roller or to the development of memory effects.

SUMMARY

It is an object to specify a device and a method with which a stable, uniformly high level of inking of the potential images on an intermediate image carrier can be achieved at high transfer efficiency. A high printing speed should thereby be possible.

A further object is to achieve a stable inking for a degree of coverage region in stationary operation. Furthermore, a large dynamic range should be possible with regard to inking (very slight level of inking, very high level of inking=inking levels), with regard to a change of inking levels, changing degrees of coverage and changing process speeds. Finally, a high process stability (long-term stability) is aimed for by minimizing stressing of the toner particles.

In a system or method for development of potential images of images to be printed and generated on an intermediate image carrier using a developer fluid comprising charged toner particles and developer fluid in an electrographic printing or copying device, a feed device is provided comprising as function elements at least one chamber scraper, a raster element comprising cups to receiver the developer fluid, and at least one first flow element arranged in the chamber scraper. Between the at least one flow element and the raster element an electrical voltage is supplied such that a toner particle concentration in the cups of the raster element is increased. An application device accepts the developer fluid from the feed device and supplies it to the intermediate image carrier.

DESCRIPTION OF THE PREFERRED EMBODIMENT

Figure 1:
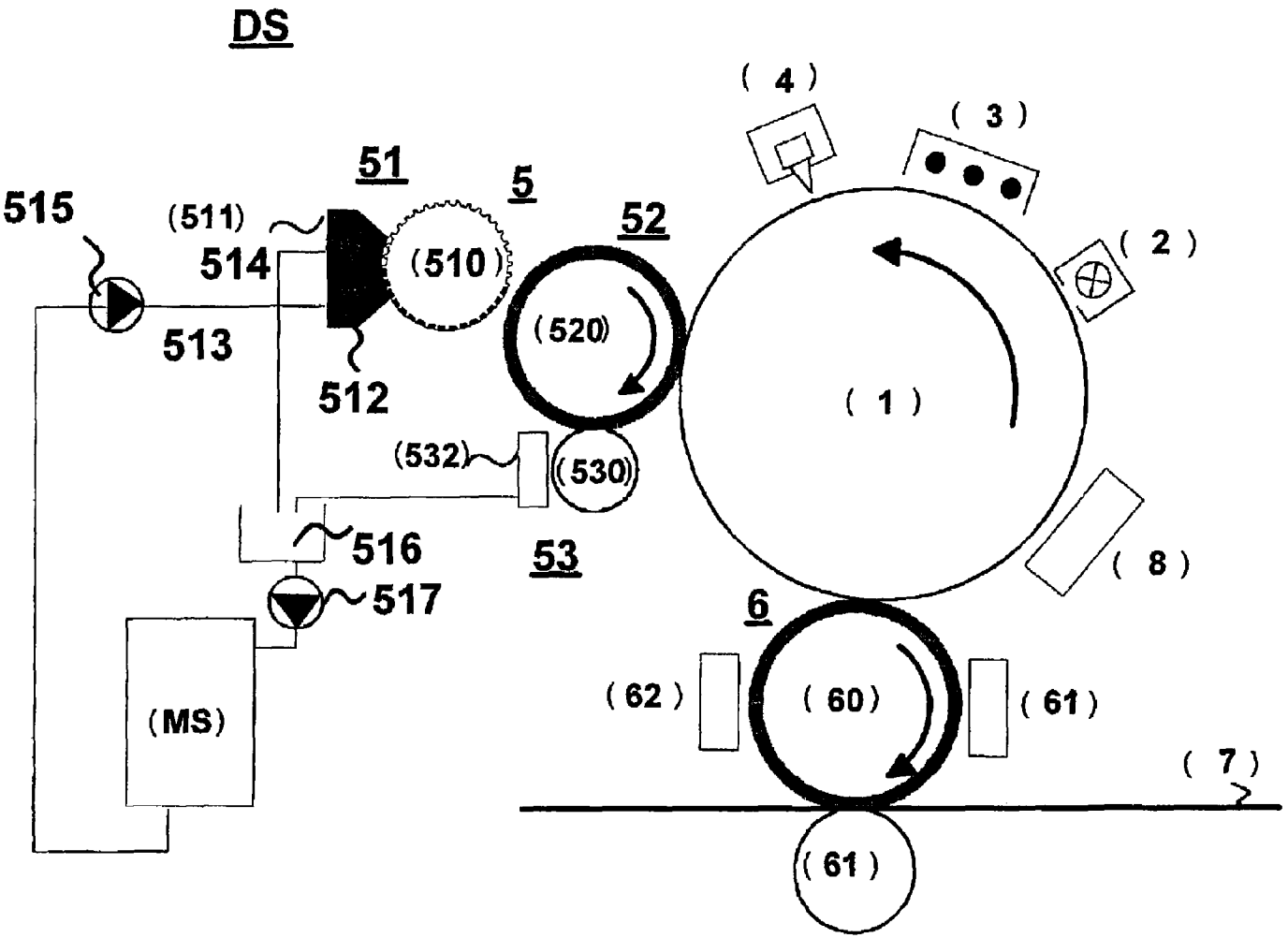
FIG. 1 shows the principle representation of an electrographic printing system.

For the purposes of promoting an understanding of the principles of the invention, reference will now be made to the preferred embodiment/best mode illustrated in the drawings and specific language will be used to describe the same. It will nevertheless be understood that no limitation of the scope of the invention is thereby intended, and such alterations and further modifications in the illustrated device and such further applications of the principles of the invention as illustrated as would normally occur to one skilled in the art to which the invention relates are included.

It is advantageous when the function elements participating in the transfer process of the developer fluid on the way to the intermediate image carrier are designed such that, in each transfer process, the accumulation time of the toner particles on the participating function elements due to an electrical field effect and the distance of the participating function elements from one another is less than the respective transfer time of the toner particles from function element to function element.

To avoid the accumulation of toner particles on function elements participating in the transfer process of the developer fluid on the way to the intermediate image carrier, it is advantageous when the function elements are designed such that a force effect towards and away from the respective function element is generated at each participating function element in every cycle in a cyclical process of the transition of the developer fluid from function element to function element.

The force effect can thereby be generated by an electrical field acting on the charged toner particles or by a flow (i.e. a shear effect). The transfer of the toner particles can additionally be supported in the electrical force effect in that the function elements participating in this alternately exhibit a high-ohmic and low-ohmic resistance.

The device for development of potential images (generated on an intermediate image carrier) of images to be printed initially possesses as a first component a feed device that extracts developer fluid from a mixing device.

The components can possess as function elements a raster roller, a chamber scraper, flow elements (within the chamber scraper).

A field that enables the dosing of a low-concentration (and therewith low-viscosity) fluid is present between these. This has the advantage that the developer fluid can exhibit lower viscosity in the mixing device and the feed device and therewith can be transported more easily. Only on the raster roller is the toner particle concentration increased to the value required for development.

Furthermore, an applicator device that (for example) possesses an applicator roller or applicator belt as a function element is provided as a second component that accepts the developer fluid from the feed device and from which the developer fluid passes onto the intermediate image carrier dependent on the potential images. In order to optimize the transfer of the toner particles, an electrical voltage is applied between feed device and applicator device such that the extent of the toner particle transfer from the feed device to the applicator device is thereby established. The toner concentration in the developer fluid can thereby additionally be further increased.

A cleaning device that cleans the residual image remaining on the applicator device after the development of the potential images is additionally provided as a third component. The cleaning device can possess the function elements: cleaning roller, cleaning scraper and cleaning flow element.

It is advantageous when an electrical voltage exists between the cleaning device and the applicator device that establishes the transfer of the toner particles of the residual image from the applicator device to the cleaning device.

Moreover, it is advantageous when an electrical voltage that makes the detachment of the toner particles of the residual image from the cleaning roller easier is applied between cleaning roller and cleaning flow element. The result is that the cleaning of the cleaning roller by the adjoining cleaning scraper does not lead to a strong mechanical stressing of the toner particles.

When the raster roller of the feed device or the cleaning roller of the cleaning device exhibits a high resistance, only a minimal electrical current conduction of advantageously <1000 μA/1 m, advantageously <100 μA/1 m occurs at the transfer region for the developer fluid between feed device and applicator device or cleaning device and applicator device. Potential fluctuations over their surfaces are then advantageously <10V, and the different potentials can be kept stable. The applicator device (applicator roller) transporting the developer fluid can thus exhibit a small resistance and the voltage drop over its surface can therewith be small, such that the potential difference (this results from the distance between charge potential or discharge potential of the photoconductor and the bias potential of the applicator device symmetrically arranged between them present in the developer gap between applicator device and intermediate image carrier (photoconductor, for example) is converted into a large electrical field strength across the developer fluid. For example, the surface layer of the applicator device can be selected such that the resistance is $<10^8$ Ω*cm, advantageously $10^5$ to $10^7$ Ω*cm.

The function elements transporting the developer fluid from cleaning device, feed device or applicator device can respectively be at least one roller that exhibits a surface coating to establish its specific resistance according to the criteria indicated above. The resistance of the surface coating of the roller in the cleaning device (cleaning roller) and the roller in the feed device (raster roller) can thereby lie in the range from $10^6$ Ω*cm to $10^{10}$ Ω*cm, advantageously $5*10^8$ to $5*10^9$ Ω*cm, and that of the roller in the applicator device (applicator roller) can be more conductive by a factor of at least 10. The function element transporting the developer fluid can also be a belt; however, in the following rollers are assumed in the explanation without limiting the invention to these.

It is advantageous when a conditioning device adjacent to the applicator device is arranged as a fourth component in front of the intermediate image carrier (as viewed in the movement direction of the developer fluid). The developer fluid to be fed to the intermediate image carrier can be influenced with this conditioning device such that the toner particles in the developer fluid move towards the surface of the applicator device. A layer that predominantly comprises carrier fluid thereby forms on the surface of the developer fluid, with the result that the unwanted inking of image locations on the intermediate image carrier is reduced. The conditioning device can be made up of a corotron (for example wire corotron) lying at a potential or of a roller (conditioning roller) lying at an electrical potential. The potential should be selected such that charges in comparison to toner particles of the same polarity are raised on the applicator roller.

If the diameters of the conditioning roller and the applicator roller are selected such that a spacing flow arises between the applicator roller and conditioning roller, the fluid surface on the applicator roller can be smoothed, with the result that the toner particles are more uniformly distributed on the surface of the applicator roller. This leads to an improved print image.

An advantageous realization of the feed device possesses a raster roller with cups and webs and a chamber scraper arranged at the raster roller. The chamber scraper can thereby contain a chamber open to the raster roller, with an inlet and an overflow for the developer fluid, wherein the inlet is designed such that the supplied quantity of developer fluid is greater than or equal to the quantity that passes to the raster roller and that drains off via the overflow as an excess quantity. The sufficient and uniform feed of toner particles into the cups of the raster roller is achieved via a sufficient feed and distribution of the developer fluid in the chamber scraper and via an electrical field assistance within the chamber scraper.

The function of the chamber scraper is further improved in that a first flow element in the chamber is provided adjacent to the raster roller for distribution of the developer fluid transverse to the printing direction in the region of the transfer of the developer fluid to the raster roller. The toner particle concentration in the cups of the raster roller is increased when an electrical voltage is applied between the first flow element and the raster roller. For this the electrical field strength between the first flow element and the raster roller can be selected in a range between 10 to $5*10^4$ V/cm.

A further improvement of the function of the chamber scraper is achieved via a second flow element that is arranged adjacent to the first flow element in the chamber and at which an electrical voltage is applied whose polarity is the reverse of that of the first flow element. This serves to stir the developer fluid of the chamber with the remaining fluid located in the cups of the raster roller (which remaining fluid remains on the applicator roller after transfer of the developer fluid). The second flow element is therefore arranged before the first flow element (as viewed in the rotation direction of the raster roller) and lies adjacent to the raster roller.

It is advantageous when both flow elements at the raster roller and at the inner contour of the chamber are arranged and shaped such that a flow of the developer fluid that is parallel to the movement direction of the raster roller surface arises in the gap between the flow elements and the raster roller. No discontinuous cross-sectional changes of the surfaces through which fluid flows (both in the axial direction and radial direction) thereby occur, and there are no zones with a flow speed of zero. The flow elements can be executed as electrically conductive profile elements that are arranged in the chamber adjacent to its opening (parallel to the raster roller) and extend over the width of the chamber and, for example, are attached in an electrically insulated manner at the side walls of the chamber. In order to achieve a large effective surface, the flow elements can be flattened in the direction towards the raster roller. The distance from the flow elements to the raster roller can be set to 10 to 2000 μm, advantageously 100 to 1000 μm.

The cleaning device can possess a cleaning roller and a cleaning scraper abutting the cleaning roller. The cleaning scraper can thereby be part of a half chamber into which the scraped-off residual image flows. From there the remaining fluid can be discharged into a mixing device. The half chamber that lies at one electrical potential is designed such that the level of the developer fluid always lies above the cleaning scraper in order to enable that the toner particles present on the cleaning roller can disperse in the half chamber. A fill level sensor that controls a discharge pump can be provided in the half chamber to adjust the level, or the adjustment of the level in the half chamber can occur via an overflow that is arranged above the cleaning scraper.

The function of the cleaning device can be improved via a cleaning flow element that is arranged in the half chamber adjacent to the cleaning roller and that is shaped such that a flow in the region between the cleaning flow element and the cleaning roller arises that is parallel to the movement direction of the surface of the cleaning roller and that exhibits no discontinuities in the flow cross-section. For this the distance from cleaning roller to cleaning flow element should be set to 10 to 2000 μm, advantageously 100 to 1000 μm. It is optimal when the cleaning flow element is arranged above the cleaning scraper but partially or completely below the level of the developer fluid in the half chamber. Furthermore, at the cleaning flow element it is appropriate to apply an electrical potential that, for example, is more negative given positive toner polarity than the potential at the cleaning roller and the cleaning scraper. The electrical voltage between cleaning roller and cleaning flow element should be selected such that the toner particles are detached from the surface of the cleaning roller, however an accumulation of the toner particles on the cleaning flow element is prevented. The electrical voltage between cleaning roller and cleaning flow element can be between 10 V and 5000 V, advantageously between 200 V and 2000 V.

A movable element (for example a helical spindle) that can be actively moved via an actuator can be arranged below the fluid level in the lower region of the half chamber, the bowl. Accumulations of toner particles in the half chamber can be avoided with this or accumulations present there can be detached.

The advantages of the device of the preferred embodiment can be summarized as follows:

- The toner particles are deposited in a defined manner on the function elements (raster roller, applicator roller, cleaning roller) or detached from the function element within the developer fluid. Fluctuations of the toner particles (charge, diameter) are thereby compensated.
- The cups of the raster roller are filled with toner particles in a defined manner due to the field support between first flow element and raster roller. The toner concentration is thereby first increased upon filling; a low-concentration (and therewith more free-flowing) developer fluid can thus be dosed beforehand.
- The increase or the stabilization of the toner concentration in the cups of the raster roller initially enables a sufficient feed of toner particles to the applicator roller
  - a) for a high inking level of the intermediate image carrier given a thickness of the developer fluid film on the applicator roller from 10 to 20 μm, advantageously 5 to 10 μm;
  - b) for high speed, for example >1.5 m/straight edge (transfer between raster roller and applicator roller).
    The use of a conditioning roller has the following advantages:
    1. it leads to the formation of a layer made up predominantly of carrier fluid on the surface of the developer fluid on the applicator roller and therewith to an increase of the limit process speed without unwanted inking of the non-image points;
    2. a stabilization of the film separation of the developer fluid in the gap between conditioning roller and applicator roller, and therewith a smoothing of the developer fluid film, and therewith a smoothing of the developer fluid film on the applicator roller, and therewith a more uniform deposition of toner particles on the intermediate image carrier, is achieved via the suitable selection of the diameter of the conditioning roller and of the applicator roller and their adjustable relative speeds;

3. the toner particle concentration of the developer fluid film remaining on the applicator roller can be increased via scraping off the carrier fluid located on the conditioning roller. Until then a better free-flowing developer fluid can be dosed. In contrast to this, in the contact between anatomical representation and intermediate image carrier a higher-concentration developer fluid leads to a lesser film thickness of the developer fluid and therewith to an increase of the electrical field, and thus to an improvement of the deposition of toner particles on the intermediate image carrier, in particular for high process speeds.

FIG. 1 shows the components of a printing system DS as it is known from WO 2005/013013 A2 corresponding to pending U.S. application Ser. No. 10/565,250; this is herewith incorporated into the disclosure. A regeneration exposure 2, a charging station 3, an exposure element 4 for exposure according to the image, a developer unit or device 5, a transfer unit 6 for transfer-printing the developed potential images onto a recording medium 7, and a cleaning element 8 for cleaning of the photoconductor drum are arranged along an intermediate image carrier 1 (a photoconductor drum in FIG. 1). The transfer unit 6 possesses an elastic transfer roller 60, a counter-pressure roller 61, and a cleaning unit 62.

In the following the developer unit 5 is addressed in more detail from the components (listed in regard to FIG. 1) arranged along the photoconductor drum; the design and the function of the remaining components is known and can be learned from WO 2005/013013 A2, for example.

Figure 2:
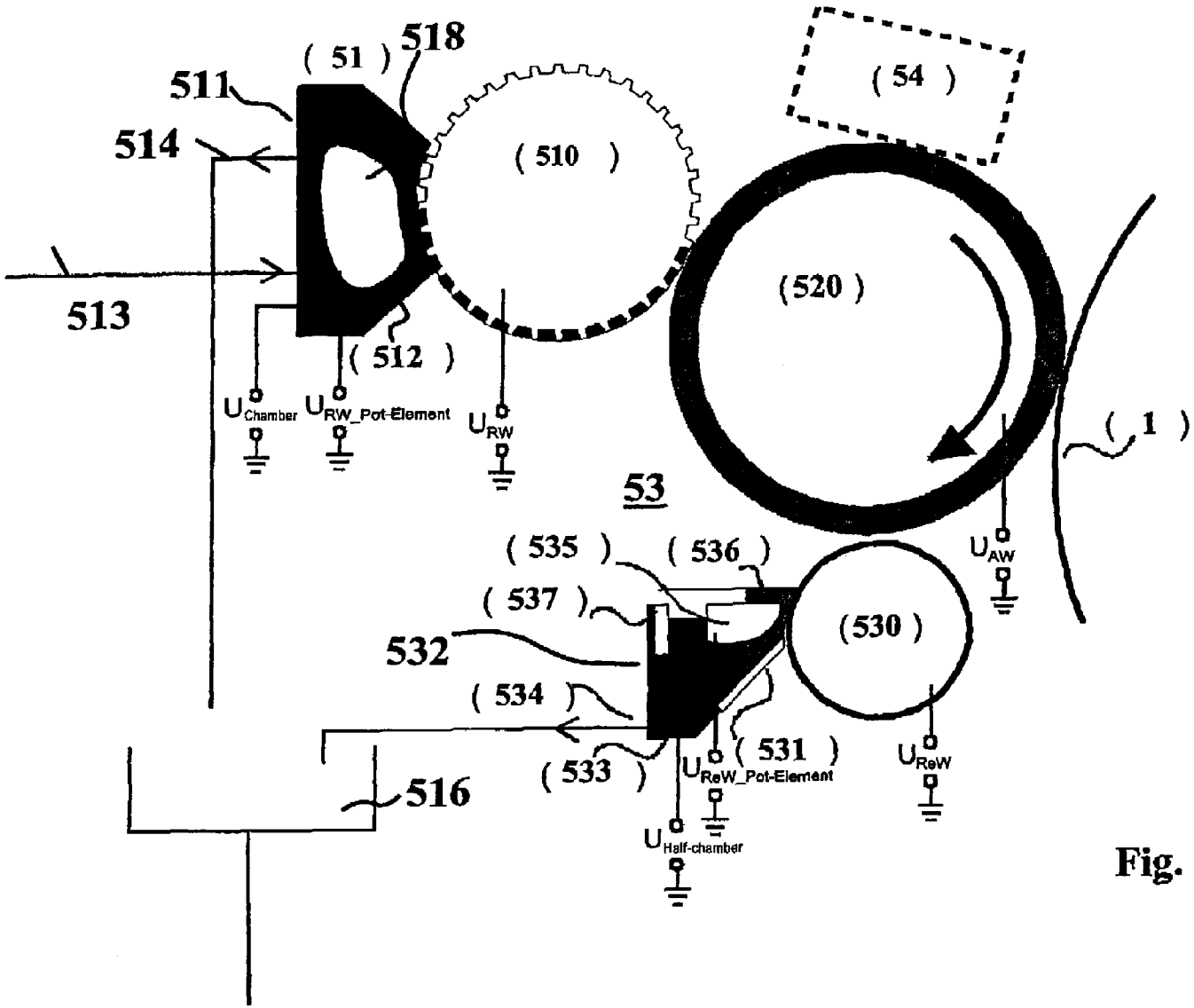
FIG. 2 illustrates the design of the device with indication of the electrical potentials present at the function elements.

The developer unit 5 possesses a feed device 51, an applicator device 52, a cleaning device 53 and optionally a conditioning device 54 (FIG. 2).

The applicator device 52 can be an applicator roller 520 or a developer belt which is arranged in contact with the intermediate image carrier 1. In the following an applicator roller 520 is discussed in the explanation of the preferred embodiment without limiting the invention to this. The potential images are developed on the intermediate image carrier 1 with the applicator roller 520. For this the applicator roller 520 feeds a developer fluid (made up of at least one carrier fluid and charged toner particles) to the intermediate image carrier 1. The development occurs in a known manner.

The developer fluid is fed to the applicator roller 520 via a feed device 51. This feed device 51 possesses a raster roller 510 with cups and webs and a chamber scraper 511 arranged at the raster roller 510. The chamber scraper is made up of at least one chamber 512, an inlet 513 and an overflow 514. The chamber scraper 511 according to FIG. 1 is described in terms of its function in WO 2005/013013 A2. The developer fluid is drawn from a mixing device MS and is fed to the chamber scraper 511 via a first pump 515. The excess developer fluid in the chamber 512 is directed via the overflow 514 into a capture basin 516 and from there the developer fluid can be pumped into the mixing device MS with the aid of a second pump 517.

Figure 3:
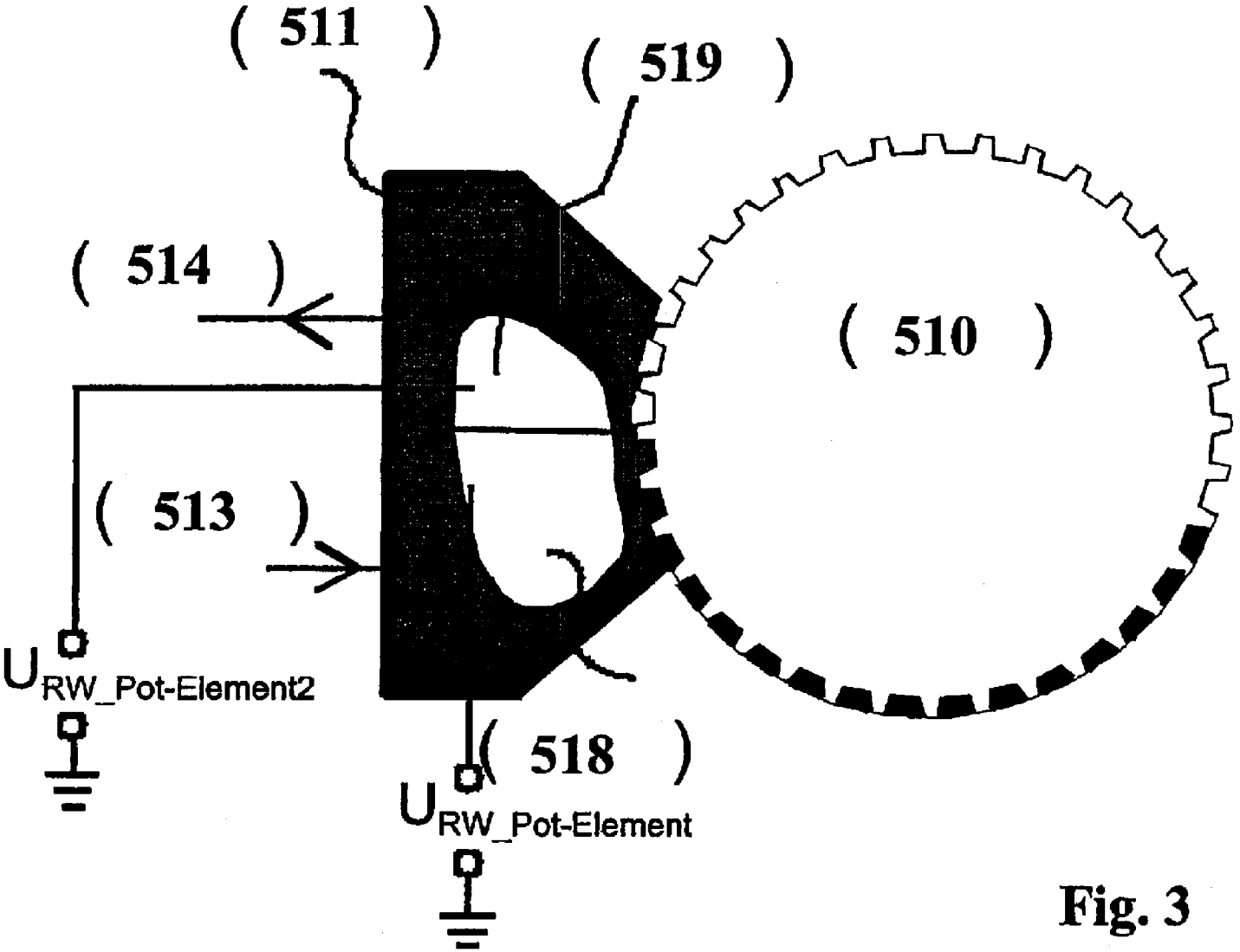
FIG. 3 is a further design of the feed device.

The more detailed design of the feed device 51 can be learned from FIG. 2 and FIG. 3. This contains the chamber scraper 511 with the chamber 512, the inlet 513, the overflow 514 and the raster roller 510 with the cups and webs. A first insulated flow element 518 to which an electrical potential $U_{RW_POT\text{-}element}$ can be applied, which first insulated flow element 518 is adjacent to the raster roller 510, is arranged within the chamber 512 of the chamber scraper 511 that is open to the raster roller 510. In a development, a second insulated flow element 519 that can be supplied with an electrical potential $U_{RW_POT\text{-}Element2}$ independent of the first flow element 518 is arranged in the chamber 512. The flow elements 518, 519 are situated parallel to the raster roller 510 and extend across the width of the chamber 512. They can be attached in an electrically insulated manner on the side walls of the chamber 512 and can be comprised of an electrically conductive profile element. The chamber 512 can likewise lie at an electrical potential $U_{Chamber}$, the raster roller 510 at a potential $U_{RW}$.

The sufficient feed of toner particles in the developer fluid into the cups of the raster roller 510, which is necessary for a high inking level of the potential images on the intermediate image carrier 1 at high printing speed, is achieved via a sufficient feed and distribution of the developer fluid into the chamber scraper 511 and via an electrical field assistance within the chamber scraper 511. An optimum of volumes of the developer fluid to be streamed along the raster roller 510 and the achievable electrical field strength is achieved as a result of the distance between raster roller 510 and the first flow element 518 provided with the potential $U_{RW_Pot\text{-}Element}$.

The supplied developer fluid is distributed via the inlet 513 into the chamber scraper 511 such that

- the fluid quantity supplied via the inlet 513 is greater than or equal to the quantity that can drain off via the cups of the raster roller 510 and the overflow 514;
- the excess quantity of developer fluid can drain off via the overflow 514;
- the flow elements 518, 519 arranged in the chamber 512 enable and support the distribution of the developer fluid transverse to the printing direction;
- the flow elements 518, 519 are arranged and shaped relative to the raster roller 510 and relative to the inner contour of the chamber 512 such that no discontinuities of the developer fluid can occur in the flow cross-section, and as a result a flow in the gap between the flow elements 518, 519 and raster roller 510 arises that is parallel to the movement direction of the surface of the raster roller 510.

The electrical field assistance is achieved via the electrical voltage between the first flow element 518 and the raster roller 510. The voltage can optionally exhibit a superimposed alternating voltage portion.

The arrangement and contour of the first flow element 518 thereby has the effect that no field strength spikes arise, and the region between the first flow element 518 and the raster roller 510 is always filled with developer fluid. The achievable field strength is correspondingly clearly higher than the blowout field strength and lies in the range between 10 to $5*10^4$ V/cm.

Optionally, the second flow element 519 can be used at which a straight alternating voltage or an alternating voltage superimposed with a direct voltage with reversed polarity can be applied. It is arranged before the first flow element 518 (as viewed in the rotation direction of the raster roller 510). The electrical field between the second flow element 519 and the raster roller 510 thus serves to stir the developer fluid with the remaining fluid located in the cups of the raster roller 510. To the contrary, the field between the first flow element 518 and the raster roller 510 serves to increase the toner concentration in the cups of the raster roller 510.

Via this realization of the feed device 51, the cups of the raster roller 510 are filled with toner particles in a defined manner via field assistance between the first flow element 518 and the raster roller 510. The toner concentration is thereby only increased upon filling the cups of the raster roller 510; a low-concentration (and therewith better free-flowing) developer fluid can thus be dosed beforehand.

The cleaning device 53 according to FIG. 2 possesses a cleaning element (realized as a cleaning roller 530 or cleaning belt) that abuts the applicator roller 520; in the following the cleaning roller is used as an example in the discussion. A cleaning scraper 531 rests on the cleaning roller 530, which cleaning scraper 531 wipes the residual image cleaned from the applicator roller 520 off the cleaning roller 530. The cleaning scraper 531 is part of a half chamber 532 that possesses a basin 533 and a drain 534. A fill level sensor 537 can optionally be provided. An electrically insulated cleaning flow element 535 can be arranged in the half chamber 532.

The cleaning scraper 531 arranged at the cleaning roller 530 is integrated into the half chamber 532. This possesses lateral seals 536, the cleaning scraper 531 and a half chamber 532. With this it is achieved that all developer fluid wiped off the cleaning roller 530 by the cleaning scraper 531 flows into the half chamber 532. The half chamber 532 is designed such that a level of developer fluid that lies above the cleaning scraper 531 is maintained, with the result that toner particles located on the cleaning roller 530 disperse in the present quantity of developer fluid. For this either a drain 534 is provided above the level of the cleaning scraper 531 or a discharge pump (not shown in FIG. 2) that can be adjusted via a fill level sensor 537 is provided.

To assist the dispersal of the toner particles in the developer fluid, the cleaning flow element 535 can be arranged near the cleaning roller 530 above the cleaning scraper 531, however partially or entirely below the level of the developer fluid. The distance can lie in the range from 10 to 2000 μm, advantageously 100 to 1000 μm. The electrical potential $U_{ReW_Pot\text{-}Element3}$ applied to the cleaning flow element 535 is more negative for a positive toner particle polarity than the potential $U_{Half\text{-}chamber}$ at the cleaning scraper 531 and the potential $U_{ReW}$ at the cleaning roller 530. The electrical voltage derived from this is sufficiently large in order to detach the toner particles from the surface of the cleaning roller 530 but small enough that an accumulation of the toner particles on the cleaning flow element 535 is prevented by the flow in the gap between cleaning roller 530 and cleaning flow element 535. The electrical voltage lies between 10 V and 5000 V, advantageously between 200 to 2000 V.

The cleaning flow element 535 is additionally shaped such that no discontinuities in the flow cross-section can occur in the gap between cleaning flow element 535 and cleaning roller 530, and therefore a flow in the gap between the cleaning flow element 535 and the cleaning roller 530 arises that is parallel to the movement direction of the surface of the cleaning roller 530.

Furthermore, a movable element (for example a helical spindle) can be arranged below the intended fluid level in the basin 533 of the half chamber 532. This element can be actively moved via an actuator and serves to avoid accumulations or to break up deposits, for example after longer operating pauses due to sedimentation.

Figure 4:
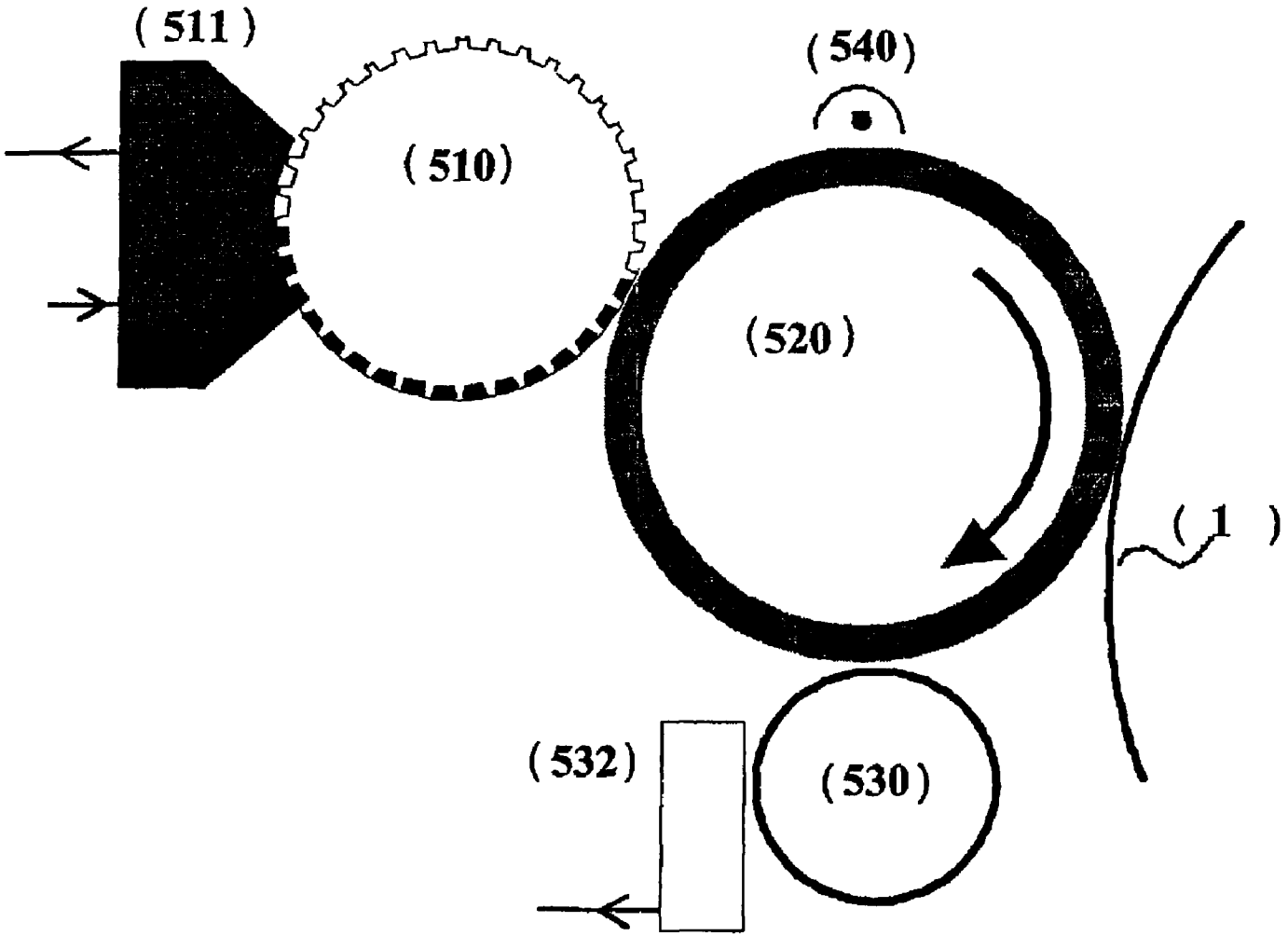
FIG. 4 is a design of the conditioning device within the developer device.
Figure 5:
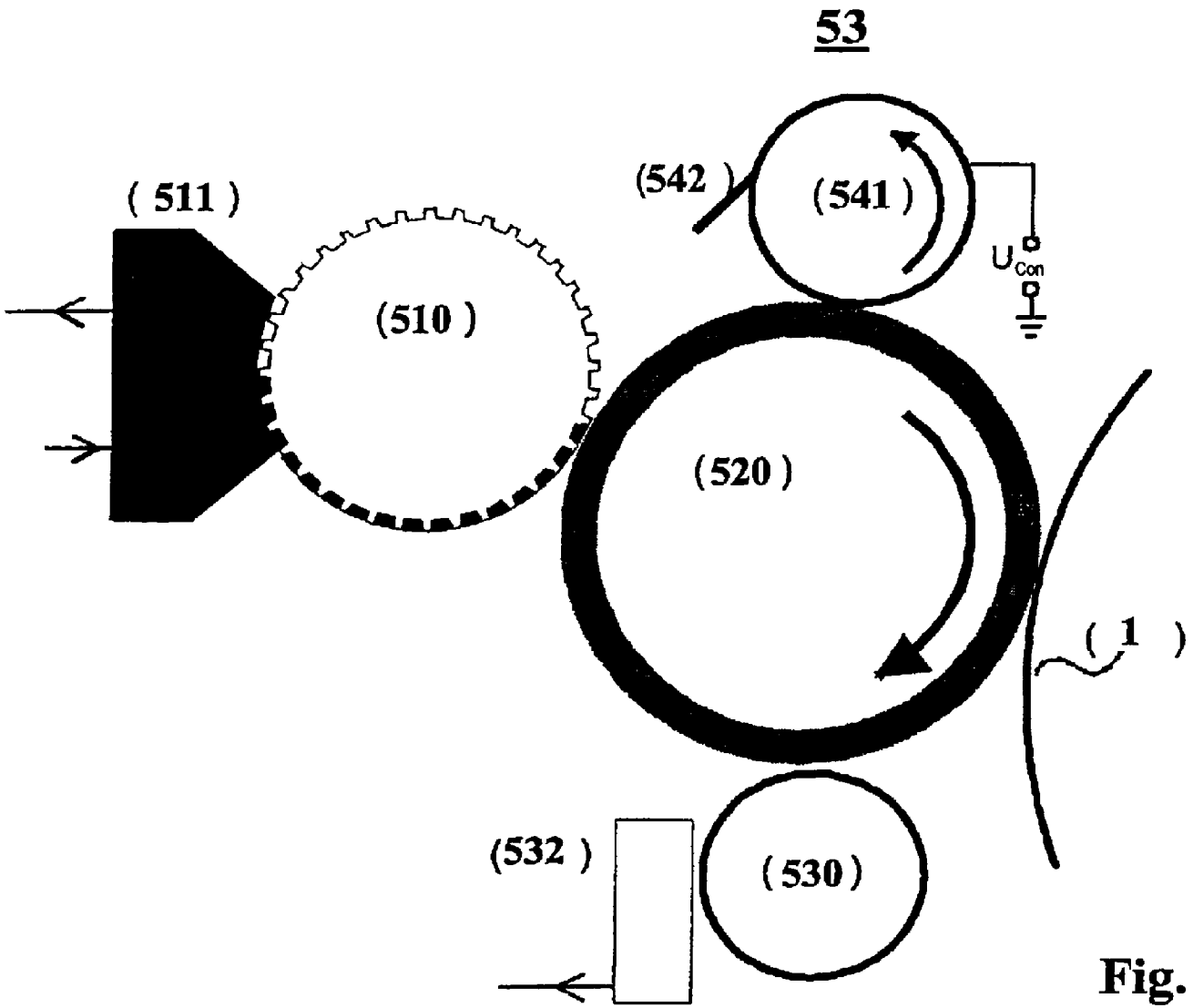
FIG. 5 is a second realization of the conditioning device within the developer device.

The conditioning device 54 (that can be optionally provided) can be comprised of either a corotron (for example a wire corotron 540 (FIG. 4)) to which an electrical potential in the polarity of the toner particles is applied or a conditioning roller 541 (FIG. 5).

Charges of the same polarity as the toner particles are applied to the applicator roller 520 via the corotron 540. The charges remain at the surface of the developer fluid due to the insulating carrier fluid. As a result of this the toner particles are displaced from the surface of the developer fluid film in the direction towards the applicator roller 520; a cover layer of carrier fluid arises on the developer fluid, which cover layer serves to prevent toner accumulations at non-image points on the intermediate image carrier 1 in the following development step.

The design of the conditioning device 54 with conditioning roller 541 arises from FIG. 5. This is located in contact with the developer fluid film on the applicator roller 520. The conditioning roller 541 is provided with a separate electrical potential $U_{Kon}$ that is higher than the electrical potential of the applicator roller $U_{AW}$. The resulting voltage between conditioning roller 541 and applicator roller 520 lies in the range from 10 V to 2000 V, advantageously in the range from 200 V to 1000 V. The applicator roller 520 and the conditioning roller 541 roll on one another. The surface speed of the conditioning roller 541 is 0.8:1 to 1:0.8 (advantageously 1:1) in comparison to the applicator roller 520. Here the toner particles are likewise displaced from the surface of the developer fluid film towards the applicator roller 520.

A separator flow between conditioning roller 541 and applicator roller 520 is additionally generated via the suitable selection of the diameter of the conditioning roller 541. For this the diameter of the conditioning roller 541 is selected in a range from 0.1 to 0.7 of the diameter of the applicator roller 520, advantageously 0.2 to 0.5. Due to the small diameter of the conditioning roller 541, the separator flow exhibits a pronounced speed vector perpendicular to the surface of the applicator roller 520. The disruption of the fluid layer thickness arising in the film division after the roller contact exhibits a small period length (<100 μm) and simultaneously low amplitude. This has the effect of a macroscopic smoothing of the fluid surface, corresponding with a uniform distribution of the toner particles on the applicator roller 520 and subsequently in the print image.

A conditioning scraper 542 can optionally be arranged at the conditioning roller 541. The conditioning scraper 542 removes the carrier fluid located on the conditioning roller 541 (which carrier fluid is poor in of toner particles due to the applied electrical field) and returns this into the mixing device MS. The film of developer fluid remaining on the applicator roller 520 exhibits an increased concentration of toner particles with simultaneously lower overall layer thickness. The field strength in the gap is determined by the unchanged applied potentials and the distance between the two. The distance reduces corresponding to the reduced layer thickness of the developer fluid and therefore leads to a higher field strength in the gap between intermediate image carrier 1 and applicator roller 520, which higher field strength is advantageous for the development process. Alternatively, it is possible to use a low-concentration developer fluid (that is therefore more free-flowing) for the conditioning device.

The rollers (raster roller 510, cleaning roller 530, conditioning roller 541, applicator roller 520) used in the devices respectively possess a surface coating. The coatings are selected such that

- no or only a slight electrical current flows via direct contact (for example webs of the raster roller 510 on the applicator roller 520, cleaning roller 530 or conditioning roller 541 on applicator roller 520), such that different electrical potentials of the rollers due to the connected mains supply circuits can be kept stable (current advantageously <100 μm/1 m roller width; potential fluctuations advantageously <+/−10 V),
- the current-limiting coating is thereby (advantageously) applied not at the applicator roller 520 but rather at the respective abutting roller (510, 530, 541)

in order to ensure a conductive coating of the applicator roller 520 (specific resistance $<10^7$ Ω*cm), whereby a low voltage drop (<10 V) occurs via the coating of the applicator roller 520, with which the potential difference (resulting from the distance between charge potential or discharge potential of the intermediate image carrier 1 and the bias potential of the applicator roller 520 that is arranged symmetrically between them) present in the developer gap (applicator roller 520 to intermediate image carrier 520) is converted into an optimally large electrical field strength (voltage/layer thickness) via the developer fluid in the developer gap;

the current-limiting coating on the raster roller 510, cleaning roller 530 and conditioning roller 541 lies in a range between $10^8$ Ω*cm and $10^{10}$ Ω*cm, advantageously $5*10^8$ and $5*10^9$ Ω*cm, wherein the voltage drop occurring across these coatings is <100 V; and a current limiter is thus present at every contact point.

The coating of the elastic applicator roller 520 can exhibit a specific resistance in the range between $10^4$ to $10^8$ Ω*cm, advantageously between $10^5$ and $10^7$; the resistance fluctuations can be <+/−20% (advantageously <+/−10%); the layer thickness lies between 3 and 12 mm, advantageously 7 to 10 mm. Among other things, NBR rubber, PUR rubber can be selected as materials. When the coating of the applicator roller 520 possesses two layers, the outer layer can comprise of PVDF, ECO, fluoroelastomer, Teflon and have a layer thickness <0.7 mm; the inner layer can comprise of the aforementioned materials.

The coating of the raster roller 510 and of the cleaning roller 530 can exhibit a resistance between $10^8$ Ω*cm and $10^{10}$ Ω*cm and a layer thickness between 10 and 400 μm, advantageously between 50 and 200 μm. Among other things, hard-anodized coating, a ceramic (Al oxide, chromium oxide, titanium oxide or a mixture of these), can be selected as a material.

As results from the explanation of the device of the preferred embodiment, all function elements are provided with a defined electrical potential. The following viewpoints have been selected for the choice of the potential:

all potentials result from the superimposition of a direct voltage portion and alternating voltage portion; each portion can thereby be zero;

all rollers (belts)—thus the applicator roller 520, the raster roller 510, the cleaning roller 530 and the conditioning roller 541—are provided with a separate potential;

the chamber scraper 511 advantageously has the same potential as the raster roller 510, optionally even a higher potential in comparison to the raster roller 510;

the cleaning scraper 531 and the half chamber 532 (lateral sealing) advantageously have the same potential as the cleaning roller 530, optionally even a higher potential;

the potentials at the flow elements 518, 519, 535 have been described above.

The potentials in the rollers (510, 520, 530, 541) are applied at their cores; given belts they are applied on their inner sides.

The potential differences listed above between the function elements have been designated as voltages in the specification.

The surface coatings of the rollers form a system of specific resistances ρ adapted to one another. It thereby applies that:

ρ(raster roller)>ρ(applicator roller);

ρ(cleaning roller)>ρ(applicator roller);

ρ(conditioning roller)>ρ(applicator roller).

The particular advantages of the device of the preferred embodiment are presented summarized in the following:

For each function element (for example raster roller 510, applicator roller 520) participating in the transfer process of the developer fluid on the way to the intermediate image carrier 1, the accumulation time of the toner particles in each transfer process is less than the quotient of the length of the respective transfer zone for the developer fluid between the respective function elements and the process speed (respective transfer time of the toner particles from function element to function element). Based on an electrical field effect, this is achieved via the combination of the resistances and the capacitances of the participating function elements and the distance of the participating function elements from one another. As a formula this can be formulated as:

$$\frac{l_{Nip}}{v_{Process}} > \frac{d_{Nip}}{v_{Accumulation}}$$

wherein $V_{acuumulation}$=μ·E with μ toner mobility and E=electrical field strength;

I=length of the transfer zone;

v=speed d=thickness of the transfer zone

To avoid permanent adhesions of toner particles on function elements participating in the transfer process of the developer fluid on the way to the intermediate image carrier 1, these are designed such that, at each participating function element in a cyclical process of the transfer of the developer fluid or portions thereof from function element to function element, in each cycle a force effect is generated towards the function element and away from the function element. The force effect can be generated by an electrical field acting on the charged toner particles or by a flow, i.e. a shear effect.

While a preferred embodiment has been illustrated and described in detail in the drawings and foregoing description, the same is to be considered as illustrative and not restrictive in character, it being understood that only the preferred embodiment has been shown and described and that all changes and modifications that come within the spirit of the invention both now or in the future are desired to be protected.

We claim as our invention:

1. A system for development of potential images of images to be printed generated on an intermediate image carrier using a developer fluid comprising charged toner particles and carrier fluid in an electrographic printing or copying device, comprising:

a feed device comprising as function elements at least one chamber scraper, a raster element comprising cups to receive the developer fluid, and at least one first flow element arranged in the chamber scraper, and between the at least one flow element and the raster element an electrical voltage is applied such that a toner particle concentration in the cups of the raster element is increased; and an applicator device that accepts the developer fluid from the feed device and supplies the developer fluid to the intermediate image carrier.

2. A system according to claim 1 in which, to avoid unwanted accumulation of toner particles on the function elements participating in a transfer process of the developer fluid on the way to the intermediate image carrier, the function elements are designed and operated such that, in transition of the developer fluid from function element to function element, a force effect on the toner particles towards the next function element and away from the preceding function element is generated in each cycle with regard to a transfer path of the developer fluid.

3. A system according to claim 2 in which the force effect is respectively generated via an electrical field acting on the charged toner particles.

4. A system according to claim 2 in which the force effect is generated via a flow.

5. A system according to claim 1 in which resistances of the function elements transporting the developer fluid are alternately high-ohmic and low-ohmic.

6. A system according to claim 1 in which a cleaning device is provided that cleans a residual image remaining on the applicator device off after development of the potential images, and an electrical voltage between said cleaning device and the applicator device is applied that establishes a transfer of the toner particles of the residual image onto the cleaning device.

7. A system according to claim 6 wherein the cleaning device has a cleaning roller and the applicator device has an applicator roller, and wherein the cleaning roller exhibits a high resistance in comparison to the applicator roller, such that only a minimal electrical current transfer occurs at a transfer region for the developer fluid between cleaning roller and applicator roller.

8. A system according to claim 6 in which the cleaning device has a cleaning belt.

9. A system according to claim 1 in which a conditioning device is provided arranged adjacent to the applicator device and before the intermediate image carrier, and that influences the developer fluid to be supplied to the intermediate image carrier such that the toner particles in the developer fluid move to a surface of the applicator device.

10. A system according to claim 9 in which the conditioning device comprises a corotron arranged adjacent to a surface of the applicator roller, said corotron lying at such an electrical potential that charges of a same polarity in comparison to charges of the toner particles are raised on the application roller.

11. A system according to claim 9 in which the conditioning device comprises a conditioning roller that lies at such an electrical potential that charges of a same polarity in comparison to charges of the toner particles are raised on the applicator roller.

12. A system according to claim 11 in which the conditioning roller exhibits a resistance that is greater than a resistance of the applicator roller.

13. A system according to claim 11 in which diameters of the conditioning roller and the applicator roller are selected such that a separator flow arises between the applicator roller and the conditioning roller, said separator flow causing a smoothing of the surface of the developer fluid on the applicator roller.

14. A system according to claim 11 in which a conditioning scraper abuts the conditioning roller.

15. A system according to claim 1 in which the feed device has as the function elements in addition to the chamber scraper a raster roller as said raster element, the raster roller accepting the developer fluid from the chamber scraper.

16. A system according to claim 15 wherein the applicator device comprises an applicator roller and wherein the raster roller exhibits a high resistance in comparison to a resistance of the applicator roller, such that only a minimal electrical current transfer occurs at a transfer region for the developer fluid between the raster roller and the applicator roller.

17. A system according to claim 15 in which the chamber scraper has a chamber open towards the raster roller, with an inlet and an overflow for the developer fluid, wherein the inlet is designed such that a supplied quantity of the developer fluid is greater than or equal to a quantity that passes to the raster roller, and such that an excess quantity drains off via the overflow.

18. A system according to claim 17 in which at least a first flow element is arranged in the chamber of the chamber scraper and wherein between the first flow element and the raster roller an electrical voltage is applied.

19. A system according to claim 18 in which a second element adjacent to the first flow element is provided as an additional function element in the chamber, said additional function element lying at an electrical voltage comprised of a direct voltage portion and an alternating voltage portion, wherein each portion can be zero and its polarity is the reverse of a polarity of the first flow elements, such that the developer fluid is stirred with remaining fluid located in the cups of the raster roller or accumulations of toner particles in the chamber scraper are prevented.

20. A system according to claim 19 in which the second flow element is arranged before the first flow element as viewed in the rotation direction of the raster roller.

21. A system according to claim 19 in which the first and second flow elements at the raster roller and at an inner contour of the chamber are arranged and shaped such that a flow of developer fluid arises in a gap between the first and second flow elements and the raster roller, which flow is parallel to a movement direction of a surface of the roller surface, and such that no discontinuous cross-section changes of streamed surfaces occur both in an axial direction and in a radial direction, and no zones with a flow speed of zero occur.

22. A system according to claim 19 in which the first and second flow elements are designed as electrically conductive profile elements that are arranged parallel to the raster roller in the chamber, adjacent to an opening of said chamber, and extend across a width of the chamber and exhibit a distance from the raster roller in a range from 10 to 2000 μm.

23. A system according to claim 19 in which the first and second flow elements exhibit a cross-section that is flattened in a direction of the raster roller.

24. A system according to claim 1 in which the applicator device has as a function element an applicator roller or an applicator belt.

25. A system according to claim 1 wherein the applicator device comprises an applicator roller and wherein the applicator roller transporting the developer fluid exhibits a slight resistance, and a voltage drop across its surface is therefore small.

26. A method for development of potential images of images to be printed generated on an intermediate image carrier using a developer fluid comprising charged toner particles and carrier fluid in an electrophotographic printing or copying device, comprising the steps of:

providing a feed device comprising as function elements at least one chamber scraper, a raster element comprising cups to receive the developer fluid, and at least one first flow element arranged in the chamber scraper, and between the at least one flow element and the raster element an electrical voltage is applied such that a toner particle concentration in the cups of the raster element is increased;

providing an applicator device that accepts the developer fluid from the feed device and supplies the developer fluid to the intermediate image carrier; and in the feed device, depositing the developer fluid in the cups of the raster element, and then transferring the developer fluid from the cups to the applicator device, and with the applicator device supplying the developer fluid to the intermediate image carrier.

27. A method according to claim 26 in which developer fluid comprising charged toner particles and carrier fluid is drawn at low toner particle concentration from a mixing device and is increased to a toner particle concentration required for inking of the potential images before the transfer of the developer fluid to the intermediate image carrier.

28. A method according to claim 27 wherein the developer fluid is drawn at low toner particle concentration raster from the mixing device via a feed device comprising as said raster element a raster roller; and the developer fluid is concentrated with toner particles in the transfer from the chamber scraper into the cups of the raster roller and is applied in concentrated form to an applicator roller as said applicator device that directs the developer fluid in concentrated form over the intermediate image carrier.

29. A method according to claim 28 in which the concentration of the developer fluid is achieved in that an electrical voltage that increases a number of the toner particles in the cups of the raster roller is applied between chamber scraper and raster roller.

30. A method according to claim 28 in which the developer fluid on the applicator roller is further concentrated with toner particles by a conditioning roller running on the applicator roller via acceptance of carrier fluid before the developer fluid is supplied to the intermediate image carrier.

31. A method according to claim 30 in which such an electrical potential is applied to the conditioning roller that the toner particles in the developer fluid on the applicator roller are displaced in a direction of a surface of the applicator roller.

32. A method according to claim 26 wherein:

the developer fluid remaining on an applicator roller of the applicator element after the development of the potential images on the intermediate image carrier is cleaned off by a cleaning roller; and the cleaned-off developer fluid is scraped into a half chamber by a cleaning scraper and drains from there into a mixing device.

33. A method according to claim 32 in which an electrical potential is applied to the cleaning roller to improve a cleaning function of the cleaning roller, and with the electrical potential transfer of the toner particles is assisted.

34. A method according to claim 33 wherein a conditioning roller is provided, and a raster roller of the raster element, the cleaning roller and a conditioning roller are provided with a separate electrical potential.

35. A method according to claim 34 in which an identical or higher potential as at the raster roller is applied at the chamber scraper.

36. A method according to claim 32 in which a same or higher potential as at the cleaning roller is applied at the cleaning scraper.

37. A method according to claim 32 wherein a conditioning roller and a raster roller are provided, and wherein surface coatings of the applicator roller, the raster roller, the cleaning roller, and the conditioning roller are selected such that a system of specific resistances ρ adapted to one another arises, whereby it applies that:

$\rho(\text{raster roller}) > \rho(\text{applicator roller})$;

$\rho(\text{cleaning roller}) > \rho(\text{applicator roller})$;

$\rho(\text{conditioning roller}) > \rho(\text{applicator roller})$.

38. A system for development of potential images of images to be printed generated on an intermediate image carrier using a developer fluid comprising charged toner particles and carrier fluid in an electrographic printing or copying device, comprising:

a feed device comprising at least one chamber scraper with a chamber, a rotatable raster roller comprising cups at a peripheral surface to receive the developer fluid, and at least one first insulated flow element arranged in the chamber scraper, and between the at least one flow element and the raster element an electrical voltage is provided such that a toner particle concentration in the cups of the raster element is increased; and an applicator device that accepts the developer fluid from the feed device and supplies the developer fluid to the intermediate image carrier.

* * * * *